US007506462B2

(12) United States Patent
Reid

(10) Patent No.: US 7,506,462 B2
(45) Date of Patent: Mar. 24, 2009

(54) EXCAVATION BUCKET ASSEMBLY

(76) Inventor: Robert L. Reid, 1042 Sandhill Shady Grove Rd., Carrollton, GA (US) 30116

( * ) Notice: Subject to any disclaimer, the term of this patent is extended or adjusted under 35 U.S.C. 154(b) by 316 days.

(21) Appl. No.: 11/607,231

(22) Filed: Dec. 1, 2006

(65) Prior Publication Data

US 2008/0127532 A1 Jun. 5, 2008

(51) Int. Cl.
*E02F 3/40* (2006.01)

(52) U.S. Cl. ..... 37/409; 37/444

(58) Field of Classification Search ..... 37/347, 37/367, 370, 380, 403, 409, 444, 449
See application file for complete search history.

(56) References Cited

U.S. PATENT DOCUMENTS 935,288 A * 9/1909 Witter ..... 37/367
2,530,414 A 11/1950 Wells
2,840,932 A * 7/1958 Breyer ..... 172/777
3,039,210 A * 6/1962 Slaughter ..... 37/404
3,238,648 A * 3/1966 Cobb et al. ..... 172/664
3,897,641 A 8/1975 Moser
5,273,375 A 12/1993 Plourde
5,526,591 A 6/1996 Otwell
5,806,607 A 9/1998 Sanders
5,833,008 A * 11/1998 Reed et al. ..... 171/141
6,067,733 A * 5/2000 Gasper ..... 37/367
6,701,630 B2 3/2004 Humphrey
6,928,758 B1 * 8/2005 Stout ..... 37/403
2008/0313934 A1 * 12/2008 Smoljo ..... 37/409

* cited by examiner

*Primary Examiner*—Gary S Hartmann
(74) *Attorney, Agent, or Firm*—Thomas, Kayden, Horstemeyer & Risley, LLP

(57) ABSTRACT

An excavation bucket assembly (10) is mounted to a tractor. A soil gathering trenching blade (48) is supported by an upwardly extending rear wall (18) and is movable down through a soil receiving opening (32) to scoop soil from beneath the ground wall (16) of the bucket, with the opening (32) being placed rearwardly of the front edge (30) of the ground wall, providing adequate space in the soil collection chamber (28) for receiving the excavated soil.

16 Claims, 4 Drawing Sheets

EXCAVATION BUCKET ASSEMBLY

TECHNICAL FIELD

The present invention concerns an excavation bucket assembly for a tractor or other heavy machine for forming both wide swaths and narrow trenches in a level surface.

BACKGROUND

Excavation buckets are mounted to heavy power equipment for removing earth and the like from a construction area. Hydraulic powered arms of the tractor manipulate the excavation bucket to lift, lower, and tilt the bucket as the bucket is advanced with the tractor.

For example, excavation buckets may be mounted to the front or to the rear of a tractor and moved with the tractor to skim along the surface of the earth and to scoop and gather and move surface soil, and to level the remaining ground surface in preparation for construction of roads, buildings, etc. Tractors with excavation buckets are often employed in excavation operations such as digging large areas and trenching operations which usually require a relatively wide and large bucket that can efficiently clear a large volume of material and transport the cleared material to another site. However, there are times when it would be desirable for excavation buckets to excavate narrow trenches or other small shapes in the ground that are narrower than the width of the excavation bucket. Because the buckets are usually too wide for the smaller width excavations, other equipment or manual labor must be used for the smaller jobs.

Thus, this invention is directed to an improved excavation bucket assembly that has the large excavation bucket that is modified for an attachment that is capable of excavating soil and other surface matter in a space narrower than the width of the bucket.

SUMMARY

This invention concerns an excavation bucket assembly for mounting to a tractor or other powered vehicle. The tractor advances the excavation bucket across the surface of the ground or other supporting surface. The excavation bucket has a ground wall for engaging the ground, with a front edge for scooping and collecting the ground soil into the bucket, and an upwardly extending back wall that is joined to the ground wall and forms a concave collection chamber for containing the collected soil.

The term "soil" is to be construed broadly to include material such as clay, gravel, flowable fill, loose material and other matter that is commonly present in the surface of the ground or resting on the surface of the ground and suitable for collecting in an excavation bucket.

In one embodiment of the invention, the excavation bucket includes a soil receiving opening formed in the ground wall that is displaced from the front edge of the ground wall. A soil gathering means such as a concave trenching blade is positioned at the opening and is movable between an up, closed position that closes the soil receiving opening and a down, open position that reaches beneath the ground wall for forming a trench in the soil below the bucket. Power means, such as an hydraulic cylinder assembly, is supported by the upwardly extending back wall of the excavation bucket for moving the soil gathering means between its closed and open positions.

The ground wall of the bucket engages and moves over the ground soil and the soil gathering means may be moved downwardly through its soil receiving opening. When in its down, open position, the soil gathering means scoops ground soil upwardly through the opening, forming a trench or other shaped configuration in the soil below the ground wall of the bucket.

In an embodiment of the invention, the excavation bucket has its upwardly extending back wall extending at an acute angle with respect to the ground wall. Moreover, when the soil gathering means move down to its open position, it moves substantially parallel to the back wall, in a path that forms an acute angle with respect to the ground wall of the bucket. This angle of movement of the soil gathering means tends to move the soil gathering means down and out of the way of the soil receiving opening to more fully open the soil receiving opening. This provides increased access of the soil up through the soil receiving opening.

Another feature of the invention may be the soil gathering means that has a forwardly facing concave trenching blade that when in its up, closed position is substantially coextensive with the inside surface of the ground engaging wall. However, the trenching blade may be concave or other shapes for engaging and scooping the soil from the ground and guiding the soil up through the soil receiving opening of the ground wall.

Another form of the invention may be that the bucket assembly includes a housing mounted to its upwardly extending back wall that encloses the power means that closes and opens the soil gathering means.

Another feature of the invention may be that the soil gathering means includes a support drawer, a concave trenching blade mounted to the support drawer, and guide tracks mounted to the excavation bucket and the support drawer for guiding the gathering means along a rectilinear path to reach below the ground wall of the bucket.

Another form of the invention may be the method of forming a trench in ground soil comprising the steps of advancing an excavation bucket along a path, the bucket including a ground wall with a leading edge and a soil receiving opening in the ground wall displaced from the leading edge of the bucket. The bucket is lowered so that its bottom wall engages and moves along the surface of the soil, and projecting a soil gathering means downwardly through the soil receiving opening in the excavation bucket in a direction that extends at an acute angle with respect to the ground wall, and, in response to advancing the excavation bucket, forming with the soil gathering means a trench in the ground soil that is of a breadth and depth that corresponds to the shape of the soil gathering means, and gathering the soil removed from the trench by the gathering means in the excavation bucket.

The heavy machine that moves the excavation bucket can be a tractor with the bucket at the front or at the rear, a heavy truck or other earth moving equipment. The expression "tractor" is considered to include various forms of powered vehicles that are capable of advancing the excavation bucket.

Thus, it is an object of this invention to provide an improved excavation bucket assembly, including an excavation bucket having an improved means for forming a trench in the surface of the ground that is of less breadth than the breadth of the excavation bucket.

Another object of the invention is to provide an improved method for forming trenches in ground soil that leave little, if any, surface soil at the edges of the trench.

Another object of the invention is to provide an improved excavation bucket which includes a soil gathering means for gathering smaller amounts of soil, with the soil gathering means being operable from the position of the vehicle operator on the tractor, not requiring a change in position or interruption of the movement of the tractor.

Other objects, features, and advantages of the present invention will become apparent upon reading the following specification, when taken in conjunction with the accompanying drawings.

DETAILED DESCRIPTION

Figure 1:
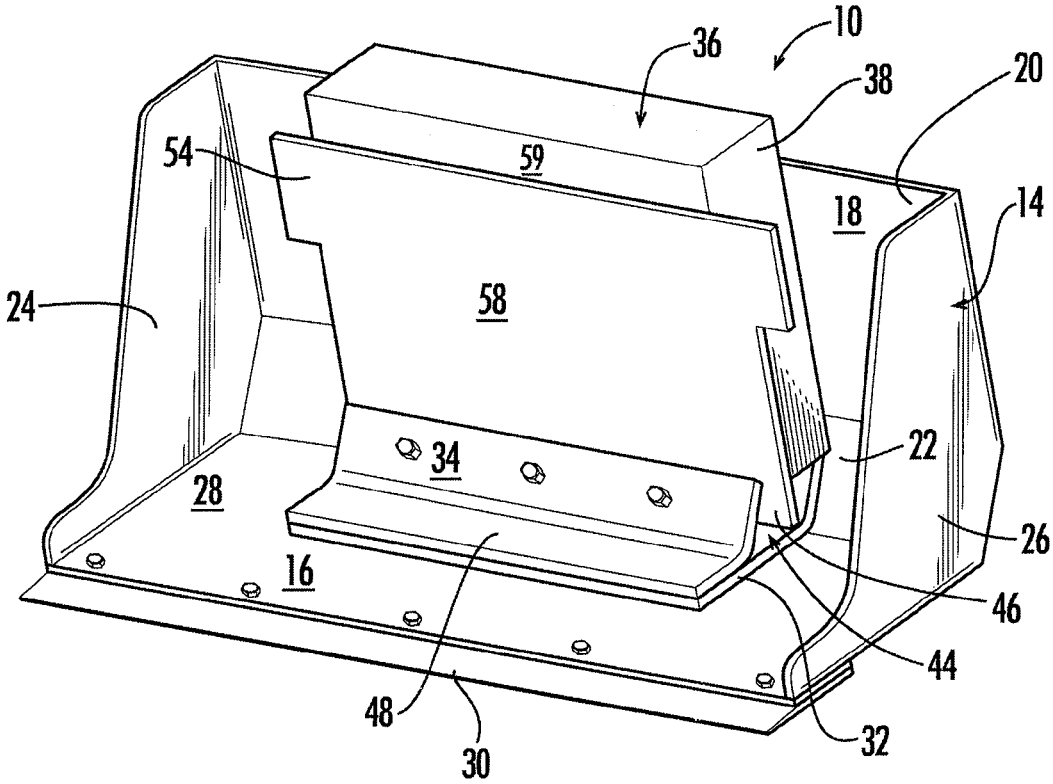
FIG. 1 is a front elevational view of an excavation bucket assembly mounted to the front of a tractor.

Referring now in more detail to the drawings, in which like numerals indicate like parts throughout the several views, FIG. 1 illustrates an excavation bucket assembly 10 that is mounted to the front of a power machine, such as a tractor 12 of conventional design. The tractor advances the excavation bucket assembly in a forward direction for the purpose of leveling soil, gathering soil, and delivering the soil to remote locations. The tractor 12 includes hydraulically powered arms for lifting, lowering, and tilting the excavation bucket so that the bucket can be manipulated to the various positions for the above noted functions.

Figure 2:
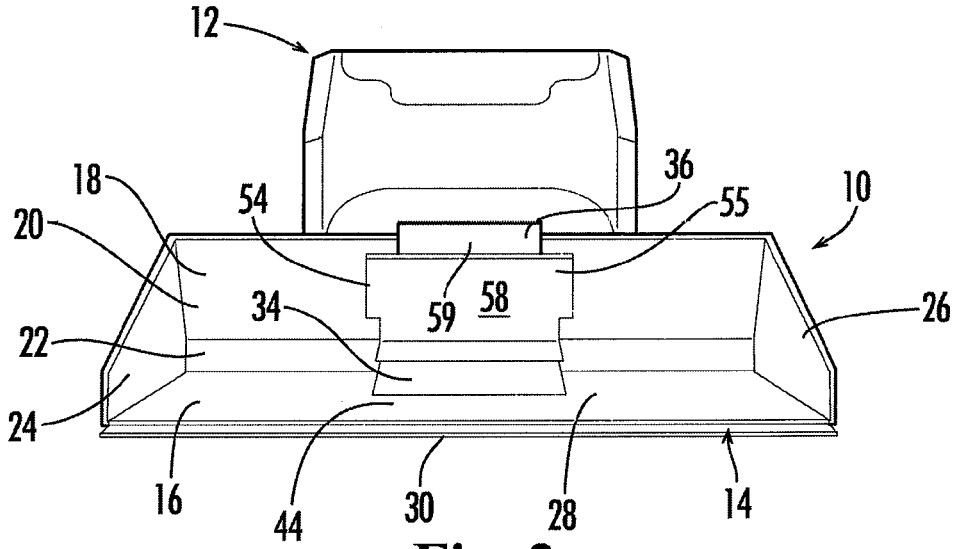
FIG. 2 is a perspective illustration of the excavation bucket assembly.

As shown in FIG. 2, the excavation bucket assembly 10 includes the excavation bucket 14 that includes a ground wall 16 that typically is moved downwardly toward engagement with the soil below the bucket, and an upwardly extending rear wall 18 that is joined to the ground wall. In this embodiment, the upwardly extending rear wall has two sections, upper section 20 and intermediate section 22, with the upper section 20 formed at an acute angle with respect to the ground wall 16. Intermediate section 22 spans the space between upper section 20 and ground wall 16, generally forming a slope between the upper section and the ground wall. Opposed side walls 24 and 26 are joined at edges to the ground wall 16 and rear wall 18, forming a soil collection chamber 28 that faces away from the tractor 12 when moving in a forward direction. A replaceable bearing blade 30 is attached to the edge of the ground wall 16, forming the front edge of the excavation bucket 14

Figure 5:
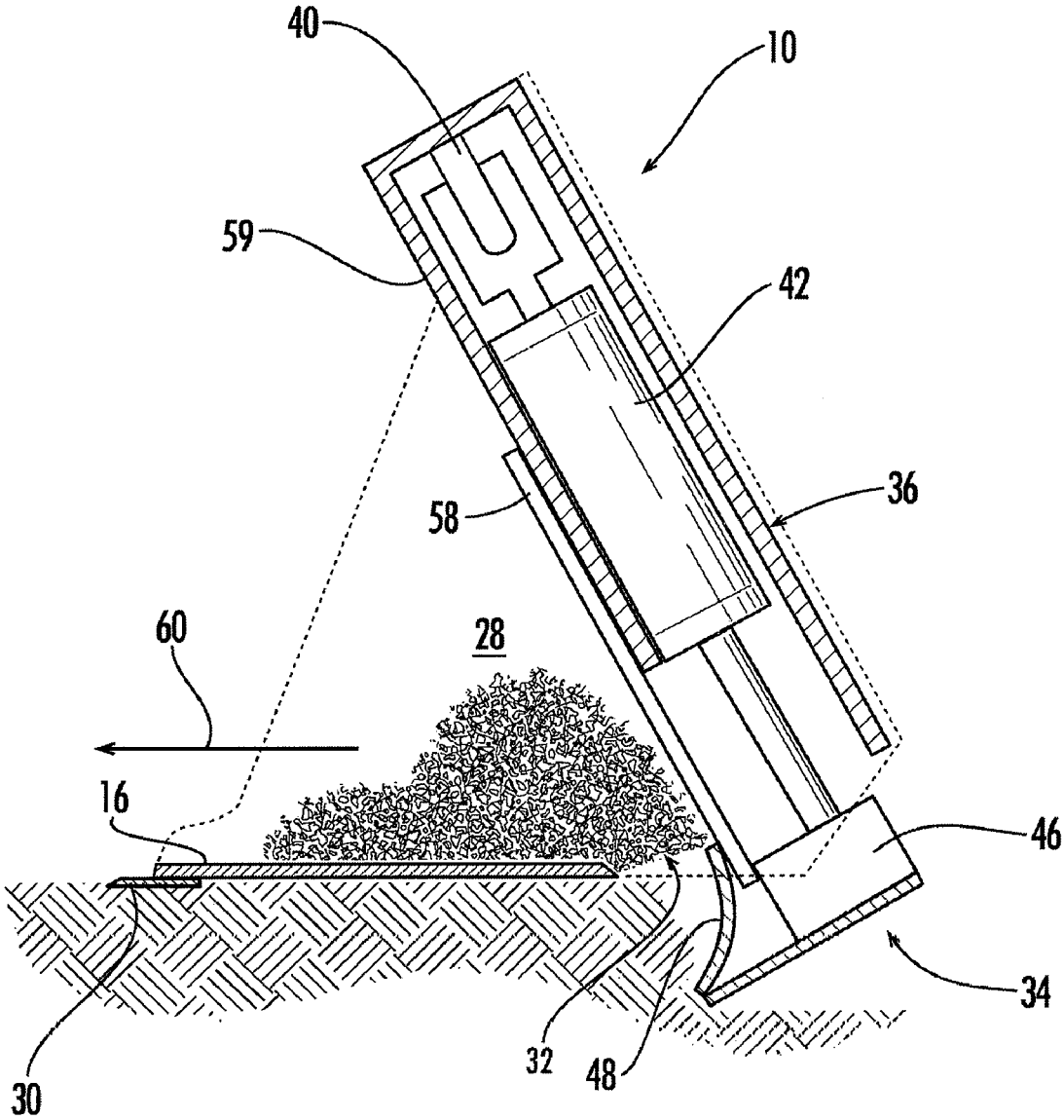

A soil receiving opening 32 is formed in the ground wall 16 and may extend up into the intermediate section 22 of the bucket 14. A soil gathering means such as the concave trenching blade 34 is mounted to the excavation bucket in alignment with the soil receiving opening 32 and is moveable between the position as shown in FIG. 2, which is its up, closed position, and a downward, open position as shown in FIG. 5.

Figure 3:
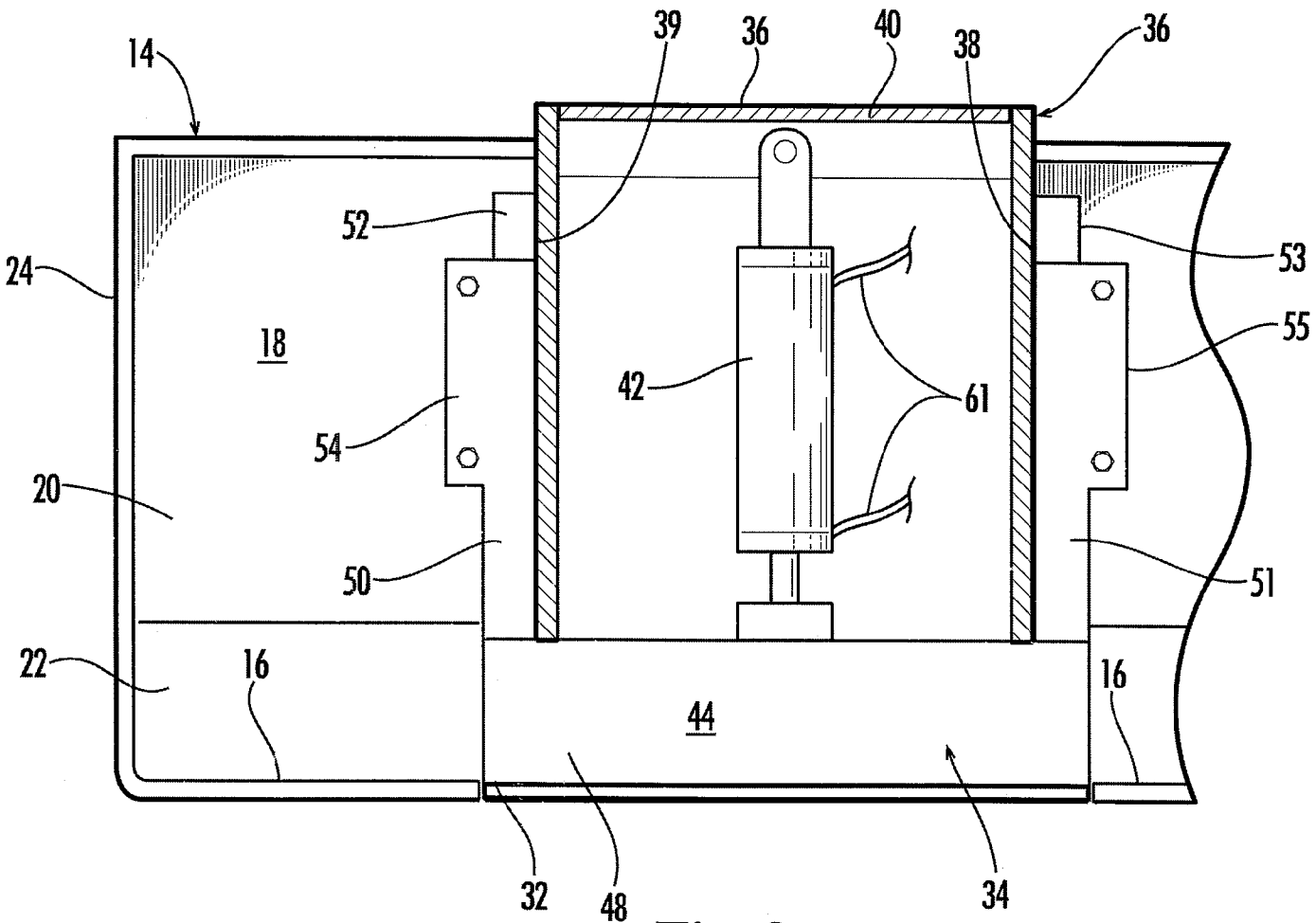
FIG. 3 is a front elevational view of a portion of the excavation bucket assembly, with the cover plates removed from the protective housing, revealing the hydraulic cylinder.

As shown in FIG. 3, a stationary housing 36 supports the soil gathering means 34. The stationary housing 36 is mounted to the upwardly extending rear wall 18 of the excavation bucket and includes side walls 38 and 39 and upper support beam 40 that extends across the upper portions of the side walls. Hydraulic cylinder 42 is mounted at its upper end to the upper support beam 40.

The soil gathering means 34 includes trenching blade assembly 44 that is moveably supported by the lower end of hydraulic cylinder 42. Trenching blade assembly 44 includes a support base 46 and concave trenching blade 48 mounted to one side of the support base 46.

Trenching blade assembly 44 is mounted at its ends to opposed upwardly extending support slides 50 and 51, each of which includes a recess (not shown) that surrounds a stationary guide track 52, 53, so that the support slides are continuously guided on and supported by the guide tracks. The support slides 50 and 51 each include projecting wings 54 and 55 that have lower edges that project out to a distance greater than the breadth of the soil receiving opening 32 in the ground wall of the excavation bucket.

When the soil gathering means 34 is to be lowered, the hydraulic cylinder 42 is distended to move the soil gathering means 34 downwardly. This includes the downward movement of the scraper blade assembly 44, the support base 46, and scraper blade 48, and the support slides 50, from the position shown in FIG. 4 to the position shown in FIG. 5. The wings 54 and 55 of the support slides 50, 51 will engage the ground wall 16 at the edge of the soil receiving opening to limit the downward movement of the soil gathering means, and to stabilize the soil gathering means in its open position. Essentially, the scraper blade assembly 44 and its support slides 50 and 51 function as a drawer in that they travel along the guide tracks 52 and 53 in a rectilinear path, much like a bureau drawer, with the guide tracks 52 and 53 avoiding any tilting of the soil gathering means when in its down, open position.

Figure 4:
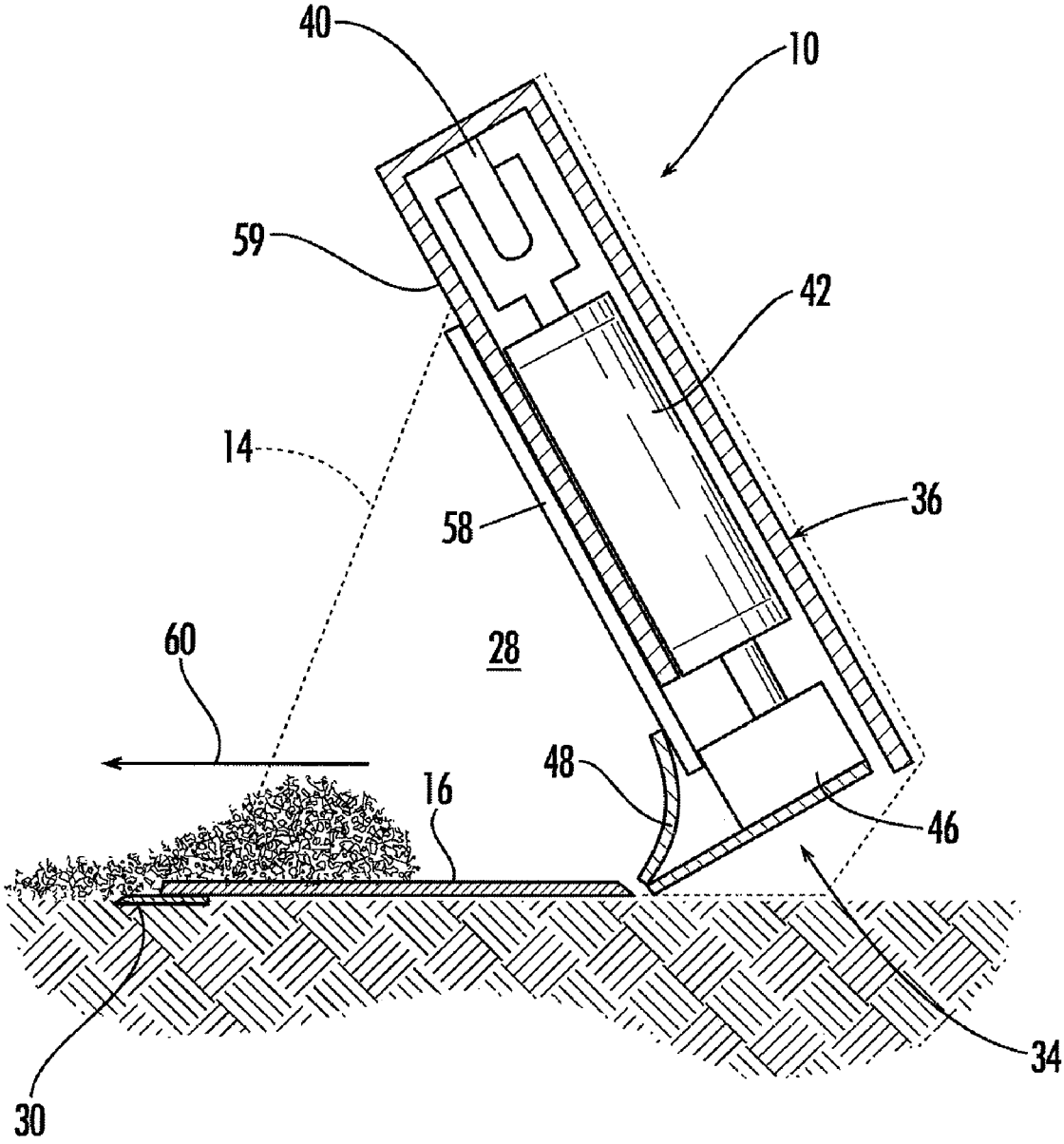
FIGS. 4 and 5 are side views, shown in cross-section, of the soil gathering means, with FIG. 4 showing the soil gathering means lifted to its up and closed position, and with FIG. 5 showing the soil gathering means lowered to its open position.

As illustrated in FIG. 4, excavation bucket assembly 10 is moved downwardly to the surface of the ground so that its ground wall 16 engages the ground. The tractor moves the excavation bucket in the direction as indicated by arrow 60 and any soil that is in the way of the front edge 30 will pass over the front edge and be collected in the soil collection chamber 28. If the excavation bucket is to be used in a situation where only a smaller width trench or other smaller shape is to be formed in the soil, the excavation bucket is lowered to substantially the same position as shown in FIG. 4, but the soil gathering means 34 is lowered by the hydraulic cylinder 42 so that it opens the soil receiving opening 32, moving the concave trenching blade 48 below the level of the ground wall 16. The advancement of the excavation bucket assembly 10 as indicated by arrow 60 then begins to scoop soil by the engagement of the oncoming trenching blade 48, and the curvature of the blade tends to guide the soil in an upward direction through the soil receiving opening 32 into the soil collection chamber 28.

In the meantime, a movable front panel 58 moves in unison with the soil gathering means 34, and extends out in front of the hydraulic cylinder 42, protecting the space about the hydraulic cylinder from the loose soil that is being moved through the soil receiving opening 32. Likewise, a stationary front panel 59 is attached to the stationary housing 36, so that a sliding arrangement exists between the panels 58 and 59, sufficiently enclosing the space about the hydraulic cylinder.

A feature of the invention may be the manner in which the soil gathering means moves from its closed position of FIG. 4 to its open position of FIG. 5. The stationary housing 36 is mounted to and supported by the upwardly extending rear wall 18. This places the stationary housing and its contents in the rear upper portion of the excavation bucket 14, which is displaced from the front edge 30 of the ground wall 16 and substantially out of the way of most of the activity that would occur within the excavation bucket. Also, the upwardly extending rear wall 18 of the excavation bucket is formed at an acute angle with respect to the ground wall 16, so that the stationary housing 36 is also formed at an acute angle with respect to the ground wall 16. This restricts the movement of the soil gathering means 34 to a path that is also formed at an acute angle with respect to the ground wall 16.

The acute angle movement of the soil gathering means 34 tends to form a significantly large passage up through the soil receiving opening 32, a greater space than would be provided if the path of movement of the soil gathering means 34 was perpendicular to the ground wall 16. Therefore, the soil receiving opening 32 and the soil gathering means may be of smaller breadth.

While the excavation bucket 14 and the soil gathering means 34 and its supporting structure, together with the soil receiving opening 32, have been illustrated with specific proportions, it will be understood by those skilled in the art that other proportions may be used. For example, if smaller trenches are desired, the width of the soil gathering means and its soil receiving opening can be made to fit the desired size.

Further, the mounting of the soil gathering means and its associated components to the upwardly extending rear wall 18 of the excavation bucket, and the tilting of the rear wall forwardly orients the structure such that maximum use is made of the collection chamber space 28 while firmly supporting the soil gathering means 34 in both its open an closed positions.

The excavation bucket assembly is designed to make asphalt patching faster and more profitable by cutting the preparation time of the conventional systems. Production can be increased, resulting in higher profits. The excavation bucket assembly can be mounted to several types of power means, such as skid steer vehicles, wheeled vehicles, tractor tread vehicles, including tractors, earth movers, trucks, etc. The use of the device leaves a clean area substantially free of dirt piles and gravel, with the removed soil being substantially entirely contained within the soil collection chamber of the excavation bucket. The product is a general purpose product, with the soil gathering means being located substantially entirely within the excavation bucket, moveable beneath the ground wall only when being used in the trenching mode. The depth of the trench can be controlled by the operator lowering the soil gathering means to a desired depth with the hydraulic cylinder. The soil gathering means 34 and the ground wall 16 are positioned so that the ground wall tends to hold the soil in place about the path of travel of the soil receiving opening as the soil gathering means lifts the soil up through the soil receiving opening. This tends to stabilize the soil at the sides of the trench that is being formed by the excavation bucket 14, and tends to leave a minimum amount of excess surface soil at the edges of the trench.

The hydraulic cylinder 42 that operates the soil gathering means has its hydraulic lines 61 connected to control valves (not shown) at the operator's position of the tractor. This allows the soil gathering means to be operable from the position of the driver on the tractor.

Although a preferred embodiment of the invention has been disclosed in detail herein, it will be obvious to those skilled in the art that variations and modifications of the disclosed embodiment can be made without departing from the spirit and scope of the invention as set forth in the following claims.

The invention claimed is:

1. An excavation bucket assembly for mounting to a tractor for the removal of ground soil in response to the movement of the tractor over the ground, comprising:

an excavation bucket having a ground wall with a front edge for engaging and collecting the ground soil, and an upwardly extending back wall joined to the ground wall and displaced from the front edge of the ground wall and forming with the ground wall a soil collection chamber for containing the collected soil, the excavation bucket including an opening formed in the ground wall displaced from the front edge of the ground wall, a soil gathering means movable between an up position that closes the opening and a down position extending from the opening outside of the collection chamber for forming a trench in the soil, and power means mounted to the upwardly extending back wall for moving the soil gathering means between its up and down positions, such that the ground wall of the bucket engages and moves over the ground soil and the soil gathering means is moved to its down position and scoops ground soil upwardly through the opening and forms a trench in the soil.

2. The excavation bucket assembly of claim 1, wherein:

the outwardly extending back wall includes an interior surface that faces the bottom wall, and the power means is supported by the interior surface of the upwardly extending back wall.

3. The excavation bucket assembly of claim 2, wherein the upwardly extending back wall and the ground wall form an acute angle and the movement of the soil gathering means is substantially parallel to the back wall.

4. The excavation bucket assembly of claim 1, wherein the power means comprises a hydraulic cylinder mounted to the upwardly extending back wall and is attached to the soil gathering means.

5. The excavation bucket assembly of claim 1, wherein the soil gathering means includes a concave trenching blade with has an internal surface facing the front edge of the ground wall, and the internal surface being substantially coextensive with the bottom wall of the excavation bucket when the soil gathering means is in its first position.

6. The excavation bucket assembly of claim 5, wherein the internal surface of the trenching blade is of a breadth that passes through the soil receiving opening.

7. The excavation bucket assembly of claim 1, and further including a housing that encloses the power means mounted to the upwardly extending back wall.

8. The excavation bucket assembly of claim 1, wherein the power means is operable from the tractor.

9. An excavation bucket assembly comprising:

a bucket having a ground wall with a front edge configured for engaging and collecting ground soil and an upwardly extending back wall joined to the ground wall, the ground wall and upwardly extending back wall defining a soil-receiving chamber, the ground wall defining a soil-receiving opening displaced from the front edge of the ground wall, a soil gathering means moveable between a first position that closes the soil-receiving opening and a second position extending downwardly from the soil-receiving opening through which soil passes upwardly through the soil-receiving opening to the soil-receiving chamber, power means mounted to the upwardly extending back wall for moving the soil gathering means between its first and second positions, such that when the soil gathering means is in its second position extending downwardly from the soil-receiving opening and the ground wall is moved on the surface of the ground soil, the soil gathering means forms a trench in the ground soil.

10. The excavation bucket assembly of claim 9, wherein the upwardly extending back wall and the ground wall form an arcuate angle and the power means is configured to move the soil gathering means substantially parallel to the upwardly extending back wall.

11. The excavation bucket assembly of claim 10, wherein the power means is mounted to the upwardly extending back wall of the excavation bucket.

12. The excavation bucket assembly of claim 9, and further including a housing mounted to the upwardly extending back wall of the excavation bucket about the power means for protecting the power means.

13. The excavation bucket assembly of claim 9, wherein the power means is configured to move the soil gathering means in a path substantially parallel to the upwardly extending back wall.

14. The excavation bucket assembly of claim 9, wherein the power means comprises a hydraulic cylinder.

15. The excavation bucket assembly of claim 9, wherein the soil gathering means includes a support drawer, a trenching blade mounted to the support drawer, and guide means mounted to the excavation bucket and the support drawer for guiding the soil gathering means along a rectilinear path.

16. A method of forming a trench in ground soil comprising:

advancing an excavation bucket including a bottom wall with a leading edge with an opening in the bottom wall displaced from the leading edge along a path, lowering the ground wall into engagement with the surface of the ground soil, projecting a soil gathering means downwardly through the opening in the excavation bucket in a direction that extends at an acute angle with respect to the ground wall into the ground soil as the excavation bucket is advancing along the path, in response to advancing the excavation bucket, forming with the soil gathering means a trench in the ground soil that is of a breadth and depth that corresponds to the shape of the soil gathering means, and gathering in the excavation bucket the soil removed from the trench by the soil gathering means.

* * * * *